United States Patent [19]

Glaze

[11] 4,397,222

[45] Aug. 9, 1983

[54] FLUID POWERED ACTUATOR SYSTEM

[76] Inventor: Stanley G. Glaze, Holley Bank, Stream Rd., Kingswinford, Brierley Hill, West Midlands DY6 9P8, England

[21] Appl. No.: 173,174

[22] Filed: Jul. 28, 1980

[30] Foreign Application Priority Data

Aug. 16, 1979 [GB] United Kingdom ..... 7928500

[51] Int. Cl.[3] ..... F15B 11/22

[52] U.S. Cl. ..... 91/515; 91/445; 91/517; 91/518

[58] Field of Search ..... 91/515, 517, 518, 532, 91/171, 445

[56] References Cited

U.S. PATENT DOCUMENTS

| | | | |
|---|---|---|---|
| 2,460,774 | 2/1949 | Trautman | 91/515 |
| 2,764,869 | 10/1956 | Scherr | 91/171 |
| 3,033,219 | 5/1962 | Erle | 91/515 |
| 3,362,299 | 1/1968 | Baron | 91/515 |
| 3,850,081 | 11/1974 | Joelson | 91/515 |
| 4,147,093 | 4/1979 | Dunn | 91/518 |
| 4,232,588 | 11/1980 | Ziplies | 91/518 |

FOREIGN PATENT DOCUMENTS

| | | | |
|---|---|---|---|
| 111109 | 7/1944 | Sweden | 91/171 |
| 2037950 | 7/1980 | United Kingdom . | |

*Primary Examiner*—Abraham Hershkovitz

*Attorney, Agent, or Firm*—Andrus, Sceales, Starke & Sawall

[57] ABSTRACT

A fluid powered actuator system has first and second piston actuators, the fluid flows to and from which pass through first and second flow paths which include respective first and second valve devices, the valve devices being coupled for operation in unison and being responsive to the flow levels therethrough, so that the valve devices operate to equalize these flows and thereby to equalize the rates of movement of the piston actuators. A further valve is responsive to a predetermined level of difference between the flows in the first and second paths to apply a servo actuating pressure which urges the first and second valve devices to a position in which flow to or from the piston actuators is prevented.

5 Claims, 1 Drawing Figure

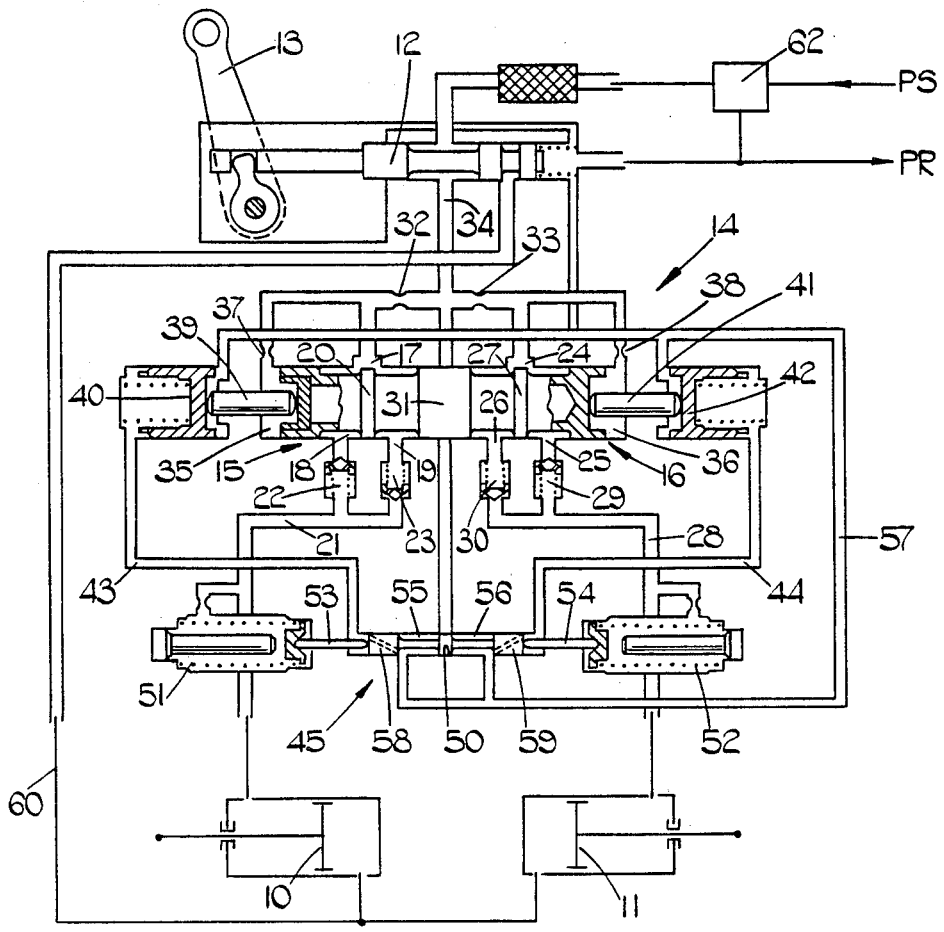
13
12
62
PS
PR
32
34
33
14
38
41
39
37
20
17
27
24
40
42
31
26
35
15
18
19
25
16
36
22
29
21
23
30
28
57
43
44
53
55
56
54
51
45
58
50
59
52
60
10
11

FLUID POWERED ACTUATOR SYSTEM

This invention relates to fluid powered actuator systems in which two output elements are required to be moved in unison.

In a fluid powered system which has two elements which are required to be moved in unison, it is frequently more convenient that each element shall be operated by a separate fluid powered actuator, instead of interconnecting these elements directly. Where identical separate actuators are provided it is necessary that the rates of flow of operating fluid to these actuators shall be substantially identical.

British patent application No. 7,848,814, now having corresponding issued U.S. Pat. No. 4,325,400, describes a control valve arrangement having two valve devices movable in unison to provide substantially equal fluid flow rates in respective ones of two fluid flow paths. The particular embodiment of the aforesaid application also provides that if fluid flow in one of the paths ceases, for example as a result of jamming of one of the actuators, the valve arrangement moves to shut off fluid flow through the other path, thereby arresting the other actuator.

It is a disadvantage of the arrangement shown in the above application that in these circumstances the shutting movement of the valve arrangement results in substantially balanced operating forces on the two valve devices, whereby these devices can readily move away from the shut-off condition.

It is an object of the present invention to provide a valve arrangement in which the foregoing disadvantage is overcome.

According to the invention a fluid powered piston actuator system comprises a pressure source, first and second piston actuators, first and second valve devices for controlling fluid flow in respective first and second flow paths between said pressure source and said first and second piston actuators, said valve devices including operably interconnected control means for increasing or decreasing flow through said first flow path and for simultaneously decreasing or increasing flow through said second flow path, means responsive to a difference between intermediate pressures in said first and second flow paths for urging said control elements in directions to reduce said difference, third and fourth piston actuators operable in response to a servo pressure signal for urging said control elements in respective opposite directions to shut off flow in said first and second flow paths, and a control valve responsive to a difference in pressure in said first and second flow paths for applying said servo pressure signal to one of said third and fourth actuators and for applying a lower pressure to the other of said third and fourth actuators.

An embodiment of the invention will now be described by way of example only and with reference to the accompanying drawing which shows, diagrammatically, a fluid powered piston actuator system.

A pair of identical actuator pistons, 10, 11 are arranged to impart simultaneous movement to respective elements of an external apparatus (not shown). One side of each of the pistons 10, 11 is subjected to a pressure which may be either a supply pressure PS or a low return pressure PR, the pressure applied being controlled by a spring-loaded spool valve 12 operable by a selector lever 13. The other sides of the piston 10, 11 are subjected to a biasing pressure, which may also be the supply pressure PS. The rods of the pistons 10, 11 provide differential areas on opposite sides of the pistons, to effect movement when both sides are subject to the pressure PS. The biasing pressure is applied to the pistons 10, 11 through a valve arrangement 14, the rates of movement of the pistons 10, 11 in either direction being dependent on the rates of fluid flow through the valve arrangement 14. The valve arrangement 14 comprises two identical valve devices 15, 16 which will now be described in detail.

The device 15 has a first port 17, and second and third ports 18, 19. A control element 20 slidably co-operates with the port 17 so that an increase or decrease in flow from the port 17 to the port 18 is accompanied by a simultaneous decrease or increase in flow from the port 19 to the port 17. The ports 18, 19 communicate with a delivery passage 21 through respective spring-loaded non-return valves 22, 23 which are arranged so that fluid can flow only from the port 18 to the passage 21 and from the passage 21 to the port 19. The valve device 14 has three ports 24, 25, 26 and a control element 27 which co-operates with the port 24 to control fluid flow there through to and from the respective ports 25,26 in a like manner to that described with reference to the valve device 15. Ports 25, 26 communicate with a passage 28 through respective non-return valves 29, 30 such that fluid can flow only from the port 25 to the passage 28 and from the passage 28 to the port 26. The control elements 20, 27 form part of a single spool 31 and therefore move in unison so that an increase or a decrease in a flow path which includes the port 17 and passage 21 is accompanied by a corresponding decrease or increase in fluid flow in a flow path which includes the port 24 and passage 28.

The ports 17, 24 communicate with the supply pressure PS through respective flow restrictors 32, 33 and a common supply passage 34. The passages 21, 28 communicate with chambers on one side of the respective pistons 10, 11.

The ends of the spool 31 are exposed to the pressures in respective compartments 35, 36. The compartment 35 communicates with the port 17 by way of a flow restrictor 37 and the compartment 36 communicates with the port 24 by way of a flow restrictor 38. A plunger 39 abuts one end of the spool 31 and extends sealingly and slidably through an end wall of the compartment 35 to abut a spring-loaded piston 40. A similar plunger 41 abuts the other end of the spool 31 and extends sealingly and slidably through an end wall of the compartment 36 to abut a further spring-loaded piston 42. Pistons 40, 42 are responsive to a servo pressure signal in respective lines 43, 44, this servo pressure signal being derived from the supply pressure PS and applied selectively to the lines 43, 44 by a control valve 45.

The valve 45 has a spool 50 which is biased towards a central position by springs 51, 52 acting through push-rods 53, 54. In the central position of the spool 50 the supply pressure PS in line 34 is not permitted to enter either of two chambers 55, 56 of the valve 45. The chambers 55, 56 can communicate with the low return pressure PR through a line 57. The sides of the pistons 40, 42 which are engaged by the respective plungers 39, 34 are also exposed to the return pressure PR by way of line 57.

The spool 50 of the valve 45 includes two lands 58, 59 which are operable to shut off communication between the respective chambers 55, 56 and the line 57. The lands 58, 59 have through passages by means of which the chambers 55, 56 communicate with the respective lines 43, 44.

In normal operation the spring-loaded pistons 40, 42 act through the plungers 39, 41 to maintain the spool 31 in the central position shown. When the valve 12 is in the position shown in the drawing one side of each of the pistons 10, 11 is exposed to the return pressure PR through a line 60. The pistons 10, 11 are displaced against the return pressure PR by flow from the source of pressure PS through flow paths which respectively include restrictors 32, 33, ports 17, 24, ports 18, 25, non-return valves 22, 29 and passages 21, 28. The rate of movement of the respective pistons 10, 11 is dependent on the rate of flow through the respective flow paths. If, for example, the piston 10 moves faster than the piston 11, the pressure between restrictor 32 and port 17 will be lower than that between restrictor 33 and port 24. The pressure in compartment 35 will thus be lower than that in compartment 36 and the spool 31 will move to the left, causing control element 20 to reduce flow to the port 18 and increase flow to the port 25. Movement of the spool 31 will cease when the pressures on the ends thereof are equal, that is when the flows to the respective pistons are equal.

With the valve 12 in its alternative operating position the supply pressure PS is applied to both the line 34 and the line 60. The differences in effective areas on opposite sides of the pistons 10, 11 cause these to move under the influence of the supply pressure in line 60 and to displace fluid from their other side through respective flow paths which include the passages 21, 28, non-return valves 23, 30, ports 19, 26, ports 17, 24 and restrictors 32, 33. Once again, the pressure between ports 17 and restrictor 32 and between port 24 and restrictor 33 is dependent on the rates of flow through the flow paths which include these elements, that is upon the rate of movement of the respective piston 10, 11. If, for example, the piston 10 moves faster than the piston 11 the pressure in compartments 35 will exceed that in compartment 36 and the spool 31 will move rightwardly to restrict flow between the ports 19, 17 and increase flow between the ports 26, 24. Movement of the spool 31 will cease when the flow rates, and hence the rates of movement of the pistons 10, 11, are once again equal.

In normal operation and with the valve 12 in the position shown in the drawing, the pressures in compartments 35, 36 are lower than the supply pressure PS while the pistons 10, 11 are moving. If, for example, movement of piston 10 is arrested as a result of jamming or external forces, all parts of the flow path between the passage 34 and the left-hand side of piston 10 will be raised to the supply pressure PS. The spool 31 will start to move rightwardly, reducing the rate of movement of piston 11. Moreover, since the pressure in passage 21 will exceed that in passage 28 the plunger 53 will urge the valve spool 50 rightwardly to the limit of its travel, allowing the line 34 to communicate with the valve chamber 55 and simultaneously isolating chamber 55 from the low pressure line 57. Supply pressure PS in line 34 is applied through the land 58 to the line 43 and acts upon the piston 40 to urge the spool 31 rightward. The line 44 is maintained in communication with the low pressure return line 57 by way of the passage in the land 59 and the valve chamber 56. The spool 31 is thus urged rightwardly to the maximum extent of its travel to shut off communication between ports 17, 19 and between ports 24, 25. Movement of the piston 11 is thereby arrested. The supply pressure PS is applied to both sides of the land 58 and to central land of the spool 50, providing a force which maintains the spool 50 in its rightward position.

When the valve 12 is operated so as to apply the supply pressure PS to both passage 34 and line 60 the pressures in the compartments 35, 36 are, in normal operation, higher than the supply pressure PS. If, in these circumstances movement of the piston 10 is arrested the pressure in the whole of the flow path between the piston 10 and the passage 34 becomes equal to supply pressure PS and the spool 31 is urged leftwardly, reducing flow from the piston 11. The pressure in passage 28, being greater than that in passage 21 causes the spool 50 of the control valve 45 to be urged leftwardly, applying the supply pressure PS in line 34 through the land 59 of the spool 50 and by way of the line 44 to the piston 42, urging the spool 31 to the leftward extent of its travel, shutting off flow between ports 19, 17 and between ports 26, 24. Movement of piston 11 is thereby stopped.

The pressure PS is applied to both sides of the land 59 and to the right hand side of the centre land of the spool 50, maintaining the spool 50 in its leftward position. The low pressure in the return line 57 is applied to both sides of the land 58.

It will be apparent that if the piston 11 is arrested as a result of jamming or the application of external forces, while moving in either direction, the control valve 45 applies a servo pressure signal to the appropriate one of the pistons 40, 42 to arrest movement of the piston 10.

The spool 31 is maintained by the servo pressure from the valve 45 in either its rightward or its leftward extremity of travel while the servo pressure is applied to line 44 or line 43, that is while there is a sufficient pressure difference between passage 21 and 28 to operate the control valve 45. Operation of the system may be restarted only if the servo pressure PS is removed and the system connected to low pressure, for example by means of a valve 62. The pistons 10, 11 and external devices connected thereto, can be mechanically realigned before the servo pressure PS is reapplied.

The valve 45 operates at a predetermined difference between the pressures in the flow paths 21, 28 the level of this predetermined difference being dependent the springs 51, 52. It will be apparent after the valve 14 has operated to equals the flow rates in the paths 21, 28 the pressures in these paths, adjacent the pistons 10, 11 differ by reason of the different flow restrictions imposed by the valve devices 15, 16. The valve 45 remains responsive to the pressure difference adjacent the pistons 10, 11 and is thus responsive to the external loads on the pistons 10, 11. The valve 45 will thus operate to shut the valve 14 in response to an unacceptable external load on one of the pistons 10, 11 even if the valve 14 has previously operated to equalise the piston speeds.

I claim:

1. A fluid powered piston actuator system comprising a pressure source (PS), first and second piston actuators (10,11), first and second valve devices (15, 16) for controlling fluid flow in respective first (21), and second (28) flow paths between said pressure source (PS) and said first and second piston actuators (10, 11), said valve devices (15, 16) including operably interconnected control elements (20, 27), for increasing or decreasing flow through said first flow path (21) and for simultaneously decreasing or increasing flow through said second flow path (28), means (35, 36) responsive to a difference between intermediate pressures in said first and second flow paths (21, 28) for urging said control elements (20, 27) in directions to reduce said difference, third (40) and fourth (42) piston actuators operable in response to a servo pressure signal for moving said control elements (20, 27) in respective opposite directions to a pair of shut off positions at which fluid flow is shut off in both of said first and second flow paths (21, 28), and a control valve (45) in fluid communication with said third (40) and fourth (42) piston actuators, said control valve (45) responsive to a difference in pressures in said first and second flow paths (21, 28) for selectively applying said servo pressure signal to one of said third and fourth (40, 42) actuators and for applying a lower pressure to the other of said third and fourth actuators (40, 42) to move said elements (20, 27) to one of said shut off positions.

2. A system as claimed in claim 1 in which said control valve comprises a valve spool (50) which is operable to derive said servo pressure signal from said pressure source (PS).

3. A system as claimed in claim 2 in which said control valve (45) includes means (58, 59) responsive to the pressure applied to said third or said fourth actuators (40, 42) for maintaining the valve spool (50) in a position in which said servo pressure signal and said lower pressure are respectively applied to said one and said other of the third and fourth actuators (40, 42).

4. A system as claimed in claim 2 or claim 3 which includes fifth (53) and sixth (54) actuators respectively responsive to the pressures in said first and second flow paths (21, 28) adjacent said first and second piston actuators (10, 11) said fifth and sixth actuators (53, 54) coacting with respective opposite ends of said valve spool (50).

5. A fluid powered piston actuator system comprising a pressure source (PS), first and second piston actuators (10, 11) first and second valve devices (15, 16) for controlling fluid flow in respective first (21) and second (28) flow paths between said pressure source (PS) and said first and second piston actuators (10, 11) said valve devices (15, 16) including operably interconnected control elements (20, 27) for increasing or decreasing flow through said first flow path (21) and for simultaneously decreasing and increasing flow through said second flow path (28), means (35, 36) responsive to a difference between intermediate pressures in said first and second flow paths (21, 28) for urging said control elements (20, 27) in directions to reduce said difference, third (40) and fourth (42) piston actuators operable in response to a servo pressure signal for moving said control elements (20, 27) in respective opposite directions to a pair of shut off positions at which fluid flow is shut off in both of said first and second flow paths (21, 28), and a control valve (45) in fluid communication with said third (40) and fourth (42) piston actuators, said control valve (45) comprising a spool 50 movable in response to a difference in pressures in said first and second flow paths (21, 28), said spool (50) having first and second lands (58, 59) and said control valve (45) including means actuable by movement of the spool (50) for selectively applying said servo pressure signal to both sides of a selected one of said lands (58, 59) and to one of said third and fourth actuators (40, 42) and for simultaneously applying a lower pressure to both sides of the other of said lands (58, 59) and to the other of said third and fourth actuators (40, 42) to move said elements (20, 27) to one of said shut off positions.

* * * * *